US007404271B2

(12) United States Patent
Kersbergen

(10) Patent No.: US 7,404,271 B2
(45) Date of Patent: Jul. 29, 2008

(54) ROOF BARRIER

(76) Inventor: Robert William Kersbergen, 7733 Owl Ridge Access Road, Mount Currie, B.C. (CA) V0N 2K0

( * ) Notice: Subject to any disclaimer, the term of this patent is extended or adjusted under 35 U.S.C. 154(b) by 630 days.

(21) Appl. No.: 10/843,509

(22) Filed: May 12, 2004

(65) Prior Publication Data

US 2005/0144854 A1 Jul. 7, 2005

(30) Foreign Application Priority Data

Dec. 22, 2003 (CA) ..... 2452066

(51) Int. Cl.
*E04D 13/00* (2006.01)

(52) U.S. Cl. ..... 52/25; 52/24; 52/26

(58) Field of Classification Search ..... 52/24, 52/25, 26; 182/113, 106, 112, 45; 248/48
See application file for complete search history.

(56) References Cited

U.S. PATENT DOCUMENTS 5,558,312 A 9/1996 Brennan
5,570,559 A 11/1996 Lewis
5,573,227 A 11/1996 Hemauer et al.
5,896,944 A 4/1999 McMillian et al.
6,070,368 A 6/2000 Anderson
6,276,668 B1 8/2001 Sweeley
6,336,623 B1 1/2002 McCarthy
6,345,689 B1 * 2/2002 McNamee ..... 182/45
2004/0103589 A1 * 6/2004 Purvis et al. ..... 52/24

* cited by examiner

*Primary Examiner*—Victor Batson
*Assistant Examiner*—Anthony N Bartosik
(74) *Attorney, Agent, or Firm*—Frederick Kaufman

(57) ABSTRACT

The barrier comprises a vertical strap, a pair of opposing centering elements for guiding extending outwardly from the vertical strap and a pair of brackets inserted into the pair of opposing centering elements for guiding. Each pair of brackets includes a flat, curved element situated in a plane perpendicular to the vertical strap and has at one extremity a cutout. A guiding plate situated in a plane parallel to the vertical strap is attached to another extremity of the flat, curved element. The guiding plate is inserted into opposing centering elements for guiding. A rail is inserted into the pair of brackets, through the cutout of each of the flat, curved element. Several U-brackets are secured to a roof structure and disposed behind the vertical strap embrace a rafter. The roof barrier includes features for attachment the vertical strap with the pair of brackets to U-brackets, through the rafters, to the roof structure.

4 Claims, 2 Drawing Sheets

ROOF BARRIER

I. BACKGROUND OF THE INVENTION

1. Field of the Invention

Figure 1:
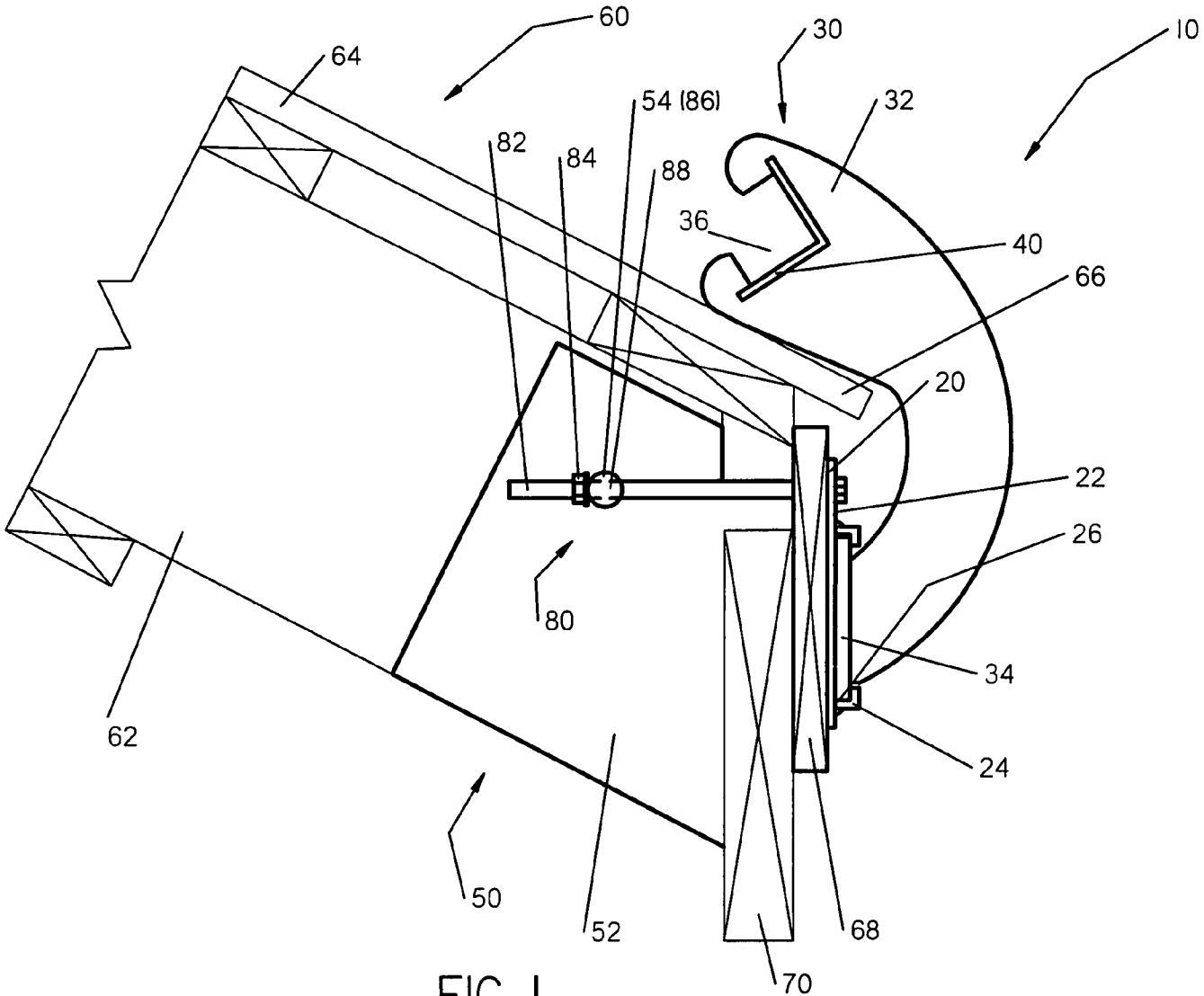

The present invention relates generally to ice guards attached to a roof structure to prevent the sliding of accumulated ice from the roof. More particularly, it relates to a roof barrier that besides holding ice loads from cascading off roofs and onto persons or structures below the edges of such roofs, can be also used on pitched roofs as a low level, safety parapet.

2. Description of the Prior Art

It has been proposed generally to attach snow barriers by nails or spikes that are driven directly down to the subroof. This system has been used for shingled roofs, particular for asphalt and wood shingles. This system however is not completely satisfactory. The nails extending into subroof may compromise the weather and water seal of the roof. To solve this problem, sealant materials are used. However, sealants are prone to failure, which can then result in a direct infiltration through the subroof along the nails.

Roof barriers besides being used as snow barriers can also being used as safety barriers.

Workman compensation claims made by employees in the roofing industry are one of the highest in industry. Many of these claims are a direct result of falling from a roof.

Attempts have been made in the past to replace the existing structures with more advanced ones. Thus, U.S. Pat. No. 6,453,623 granted on Sep. 24, 2002 to Nelson et al. for a "Roof Snow Barrier" discloses a barrier comprising brackets and rails, both forming an assembly entirely supported by a roof. The shortcomings of this device reside in the fact that 1) the support of the barrier entirely on the roof can void manufacture's warranty for the shingles and 2) the barrier is cumbersome. U.S. Pat. No. 6,357,184 granted on Mar. 19, 2002 to Alley for a "Snow Guard System Having A Flag Type Attachment" describes a device attached to a roof as part of a snow guard system to prevent snow or ice from falling off the roof. A plurality of brackets is used. Each bracket has a bore through which a pipe is inserted. One or more flags is/are attached to the pipe. The device has two disadvantages. First, it is complicated. Second, it is entirely supported by the roof. U.S. Pat. No. 6,345,689 granted on Feb. 12, 2002 to McNamee for a "Rooftop Fall Protection System" discloses a system including a plurality of J-shaped stanchions that are attached to the roof. The shorter leg of each stanchion engages the underside of one of the roofing rafters and extends downward therefrom, the longer leg of each stanchion being interconnected with the roof's facia board by a facia board mounting clamp and extends upwardly from the roof. The interconnecting portion between the above-noted legs extends under the facia board. McNamee's system is not resistant enough and has an attachment only to the facia and the structure of the roof.

II. SUMMARY OF THE INVENTION

In view of the above considerations based on the identified prior art, there is a need to address roof barriers design concerns and, consequently, to develop a roof barrier that eliminates or, at least, alleviates the foregoing disadvantages and shortcomings.

Thus, the main objective of the present invention is to construct a roof barrier that must not only be strong enough to hold the weight of the accumulated snow, which can be considerable, but also the barrier must not damage the roof either during installation or while the bracket is loaded while holding the snow up on the roof.

Another objective of the present invention is to provide a roof barrier which is reliable, simple and allows to reduce the material and labor costs. Such savings may be passed to the users, Another yet objective of this invention is to provide a well-engineered roof barrier, well-tested and compact.

Broadly stating, the present invention provides a roof barrier comprising, in combination, a vertical strap having an exposed surface;

a pair of opposing centering elements for guiding, which extend outwardly from the exposed surface;

a pair of brackets inserted into the pair of opposing centering elements for guiding at each extremity of said vertical strap.

Each one of the pair of brackets includes a flat, curved element situated in a plane perpendicular to the vertical strap and having at one extremity a cutout therethrough;

a guiding plate situated in a plane parallel to the exposed surface and attached to another extremity of the flat, curved element; the guiding plate being inserted from one end of said vertical strap into opposing centering elements for guiding.

A rail, having a transversal cross-section substantially commensurate with the cutout is inserted into the pair of brackets, respectively through the cutout of each of the flat, curved element. Several U-brackets adaptable to be secured to a roof structure are disposed behind the vertical strap and adaptable to embrace a rafter, which is part of the roof structure, from a bottom of the rafter. More specifically, each of the several U-brackets engages a portion of the rafter adjacent to the vertical strap. The roof barrier includes as well several features for attachment the vertical strap together with the pair of brackets to the several U-brackets and further, through the rafters, to the roof structure.

In one aspect of the invention the vertical strap is provided with a plurality of pairs of apertures, each of the pair of apertures being so spaced to flank each raft.

In another aspect of the invention the flat curved element, viewed in profile and starting from the guiding plate, extends outwardly being adapted to prevent a contact with a roofing, respectively with a lower end of the roofing and, then, to locate the rail above the lower end, extends backwardly, parallel to the roofing. A relatively small gap is provided between the flat curved element and the lower end to prevent contact between the former and the latter.

In yet another aspect the roof barrier, each U-bracket has its legs traversed by coaxial perforations, collinear with a hole drilled in the rafter, and the features for attachment include each a pair of bolts and nuts and a pin having a diameter commensurate with the hole and cross-drilled openings coaxial with the pair of apertures that flanks the rafter.

III. BRIEF DESCRIPTION OF THE DRAWINGS

Figure 2:
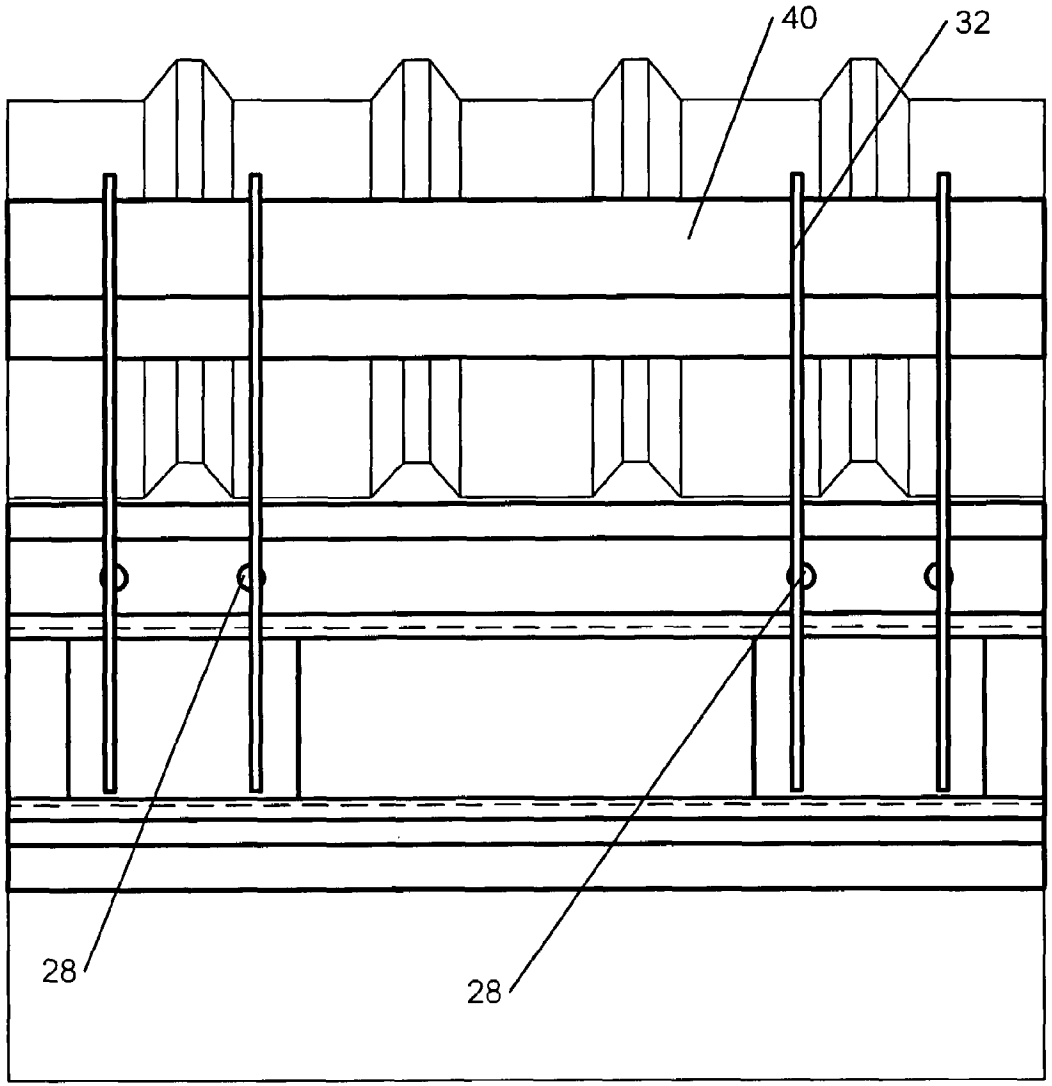

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

FIG. 1 illustrates a side view of the roof barrier according to the present invention; and FIG. 2 illustrates a front view of the roof barrier of FIG. 1.

IV. DESCRIPTION OF THE PREFFERED EMBODIMENT

Referring to the drawings, there is illustrated a roof barrier generally designated 10. It is to be agreed that terms indicating positions of some components of roof barrier 10 are conventionally used in the present description with reference to the normal position in which roof barrier 10 would be used.

In general, roof barrier 10 comprises a vertical strap 20 having an exposed surface 22 from which a pair of opposing centering guides 24 extends outwardly.

A pair of brackets 30 is inserted, at each extremity of vertical strap 20, into opposing centering guides 24. Each bracket 30 includes a flat, curved element 32, situated in a plane perpendicular to vertical strap 20, and a guiding plate 34, situated in a plan parallel to exposed surface 22.

Guiding plate 34 is permanently attached to one extremity of flat, curved element 32. At another extremity, flat curved element 32 is provided with a cutout zone 36 therethrough. Guiding plate 34 is inserted from one end of vertical strap 20 into opposing centering guides 24.

A rail 40 having a transversal cross-section substantially similar to that of cutout zone 36 is inserted throughout all cutout zones 36 of brackets 30.

Several U-brackets 50, which are also part of roof barrier 10, are secured to a roof structure 60. U-brackets 50 are disposed behind vertical strap 20. Each U-bracket 50 embraces a rafter 62 from a bottom of the latter and more specifically U-bracket 50 engages a portion of rafter 62 that is adjacent to vertical strap 20. Rafter 62 is part of roof structure 60.

A plurality of attachment assemblies 80 is used to secure vertical strap 20 together with brackets 30 to U-brackets 50 and further, throughout rafters 62, to roof structure 60.

Referring now in detail to the preferred embodiment of roof barrier 10, vertical strap 20 is made together with opposing centering guides 24 as a unitary part, conveniently by aluminum extrusion. Each opposing centering guide 24 is L-shaped and has one opening 26 facing another opening 26 of an opposing centering guide 24.

Vertical strap 20 incorporates as well a plurality of pairs of apertures 28 that are so spaced to correspond to each rafter 62. Each pair of apertures 28 flanks a rafter 62.

Each bracket 30 uses a welding joint (not shown) for securing flat, curved element 32 to guiding plate 34. Cutout zone 36 has a peripheral shape corresponding to an angle beam, so that rail 40 that is made of commercial L-beam can be inserted transversally, with clearance, into cutout zone 36. Flat, curved element 32, viewed in profile and starting from the welding joint for securing to guiding plate 34, extends outwardly. Thus, flat, curved element 32 is adapted to prevent a contact with a roofing 64, respectively with its lower end 66. Then, to locate rail 40 above lower end 66, flat, curved element 32 extends backwardly, parallel to roofing 64. Furthermore, to prevent a contact between roofing 64, respectively its lower end 66 and flat, curved element 32, a relatively small gap is provided between the former and the latter.

Each U-bracket 50 is fixed to a rafter 62 by conventional fasteners, well known to those skilled in the art. Hence, a further detailed description of this aspect is not deemed necessary.

In order to attach roof barrier 10 to roof structure 60, throughout rafters 62, each U-bracket 50 has its legs 52 traversed by a pair of coaxial perforations 54 that are collinear with a hole (not shown) drilled in rafter 62.

Each attachment assembly 80 includes a pair of bolts and nuts 82 and 84, respectively, and a pin 86. The latter has a diameter commensurate with the hole in rafter 62 and is provided with a pair of cross-drilled openings 88. The latter are coaxial with each pair of apertures 28 that flanks a rafter 62.

To assembly roof barrier 10 in situ, vertical strap 20 is placed on a mounting board 68. The latter is located under lower end 66 of roofing 64 and is in contact with an adjacent fascia board 70 that is firmly joined to rafters 62. A pair of bolts 82 is inserted into each pair of apertures 28 of vertical strap 20, then passes through a pair of cross-drilled openings 88 of pin 86 and is finally tightened by a pair of nuts 84.

Alternatively to what has been described in the foregoing preferred embodiment, vertical strap 20 can be made of steel using a separate strip to which a pair of opposing centering guides 24 is joined by welding. Furthermore, besides the use of cutout zones 36 having a circumferential shape corresponding to an angle beam, so that rail 40 that is made of commercial L-beam can be inserted transversally, other convenient configurations can be contemplated. The configurations should be so designed to permit an easy transversal insertion of a rail 40 into brackets 30, concomitantly preventing a relative rotation of rail 40 with respect to brackets 30. Moreover, alternatively to the foregoing detailed embodiment wherein each bracket 30 incorporates a single cutout zone 36, brackets 30 containing two or more spaced, superposed cutout zones 36 can be contemplated. In this case two or more rails 40, disposed in parallel, are used.

As required, a detailed embodiment of the present invention is disclosed herein; however, it is to be understood that the disclosed embodiment is merely exemplary of the invention, which may be embodied in various forms. Therefore, specific structural and functional details disclosed therein are not to be interpreted as limiting, but merely as a basis for the claims and as a representative basis for teaching one skilled in the art to variously employ the present invention in virtually any appropriately detailed structure.

The embodiments of the invention in which an exclusive property or privilege is claimed are defined as follows:

1. Roof barrier comprising, in combination, a vertical strap having an exposed surface;

a pair of opposing centering means for guiding, which extend outwardly from said exposed surface;

a pair of brackets inserted into said pair of opposing centering means for guiding, at each extremity of said vertical strap, each one of said pair of brackets including a flat, curved element situated in a plane perpendicular to said vertical strap and having at one extremity a cutout therethrough;

a guiding plate situated in a plane parallel to said exposed surface and attached to another extremity of said flat, curved element; said guiding plate being inserted from one end of said vertical strap into opposing centering means for guiding;

a rail, having a transversal cross-section substantially commensurate with said cutout, inserted into said pair of brackets, respectively through said cutout of each of said flat, curved element;

several U-brackets adapted to be secured to a roof structure and disposed behind said vertical strap, each one of said several U-brackets being adapted to embrace a rafter, said roof structure incorporating several rafters, by starting from a bottom of said rafter and engaging a portion of the latter that is adjacent to said vertical strap; and means for attachment said vertical strap together with said pair of brackets to said several U-brackets and further, through said several rafters, to said roof structure.

2. Roof barrier, as defined in claim 1, wherein said vertical strap is provided with a plurality of pairs of apertures, each of said pair of apertures being so located and spaced as to flank each of said rafters.

3. Roof barrier, as defined in claim 1, wherein said flat curved element, viewed in profile and starting from said guiding plate, extends outwardly being adapted to prevent contact with a roofing, respectively with a lower end of said roofing and, then, to locate said rail above said lower end, extends backwardly, parallel to said roofing; further a relatively small gap being provided between said flat curved element and said lower end to prevent contact between the former and the latter.

4. Roof barrier, as defined in claim 1, 2 or 3, wherein each said U-bracket has its legs traversed by coaxial perforations, collinear with a hole drilled in said rafter, said means for attachment including a pair of bolts and nuts and a pin having a diameter commensurate with said hole and provided with cross-drilled openings coaxial with said pair of apertures that flanks said rafter.

* * * * *